US005363835A

United States Patent [19]

Robson

[11] Patent Number: 5,363,835

[45] Date of Patent: Nov. 15, 1994

[54] NOSE BLOCK ASSEMBLY

[75] Inventor: Angus P. Robson, Matamata, New Zealand

[73] Assignee: Rocktec Limited, Matamata, New Zealand

[21] Appl. No.: 938,363

[22] Filed: Aug. 31, 1992

[51] Int. Cl.[5] ..... B28D 1/26

[52] U.S. Cl. ..... 125/40; 173/13; 173/162.1

[58] Field of Search ..... 125/40; 173/13, 17, 173/40, 105, 131, 92, 89, 162.1

[56] References Cited

U.S. PATENT DOCUMENTS 3,017,810 1/1962 Jacklin ..... 125/40
3,889,762 6/1975 Sumner ..... 173/162.1
3,910,357 10/1975 Nancarrow ..... 173/131
3,998,278 12/1976 Stiltz et al. ..... 173/13
4,165,788 8/1979 Montabert ..... 173/17
4,325,437 4/1982 Swindall et al. ..... 173/131
4,759,412 7/1988 Brazell, II ..... 173/92
4,838,363 6/1989 MacOnochie ..... 173/89
4,858,701 8/1989 Weyer ..... 173/105

*Primary Examiner*—M. Rachuba
*Attorney, Agent, or Firm*—Abelman, Frayne & Schwab

[57] ABSTRACT

In a rock-breaking apparatus of the type employing a striker pin and hammer providing shock absorbing means housed within the nose block to protect the nose block and its carrier from primary and/or recoil shock loads during use.

6 Claims, 5 Drawing Sheets

NOSE BLOCK ASSEMBLY

INTRODUCTION TO INVENTION

This invention relates to rock-breaking apparatus of the type employing a striker pin adapted for limited axial movement within a nose block assembly upon impact from a hammer means. Such apparatus is described in Australian Patent No. 585274.

BACKGROUND OF INVENTION

This type of apparatus commonly involves large force and shock transmissions from a hammer to a striker pin as a means of breaking rocks. The forces involved in such an action can place high stresses on the entire apparatus including the machinery supporting same.

In order to miniraise the damage such forces can cause to the apparatus modifications have been proposed with a view to absorbing structurally damaging shock as it occurs in this type of apparatus.

In Australian Patent No. 585274 there is disclosed rock-breaking apparatus, which apparatus includes a guide column within which a weight falls under gravity to strike a tool. A piece of shock-absorbing material is located at or near the base of said column such that it enables force to be transmitted from said weight to the tool, while miniraising the effect of the impact of said weight on other parts of the apparatus.

Whilst such an arrangement miniraises the effect of the impact of the weight on the apparatus, rock-breaking apparatus of the type disclosed in Australian Patent No. 585274 is often used to break very hard types of rock. Often, this means that several blows will be required to cause a single fracture in the rock. On each occasion where the rock does not break, there occurs a recoil through the tool to the apparatus, causing stress in the entire apparatus and in the carrier for the apparatus.

OBJECT AND STATEMENT OF INVENTION

One object of the invention is to provide an improved nose end assembly for rock breaking apparatus of the kind described.

According to the present invention there is provided a nose assembly for a rock breaking apparatus of the kind described, Said assembly having a striker pin and retainer supported within a nose block housing, said retainer being located adjacent shock absorbing means of said nose block housing.

According to a further aspect of the present invention the housing substantially encloses the retainer and shock absorbing means.

According to yet a further aspect of the present invention the retainer is sandwiched between the shock absorbing means within the housing.

The invention also provides a striker pin arrangement for rock breaking apparatus, said arrangement including a striker pin having opposed recesses and striker pin retaining means, said means being adapted to receive said recesses to retain said pin with limited movement relative thereto wherein at the limit of striker pin extension the movement thereof is taken up by said pin retaining means and transmitted to a shock absorbing means.

The striker pin retaining means may further comprise a plate and one or more retaining pins wherein said plate is adapted to locate said retaining pins within a nose block whilst engaging said recesses to retain said striker pin with limited movement relative thereto.

The shock absorbing means may comprise a number of layers of shock absorbing material of identical, similar or differing resilience.

DETAILED DESCRIPTION OF THE INVENTION

Figure 1:
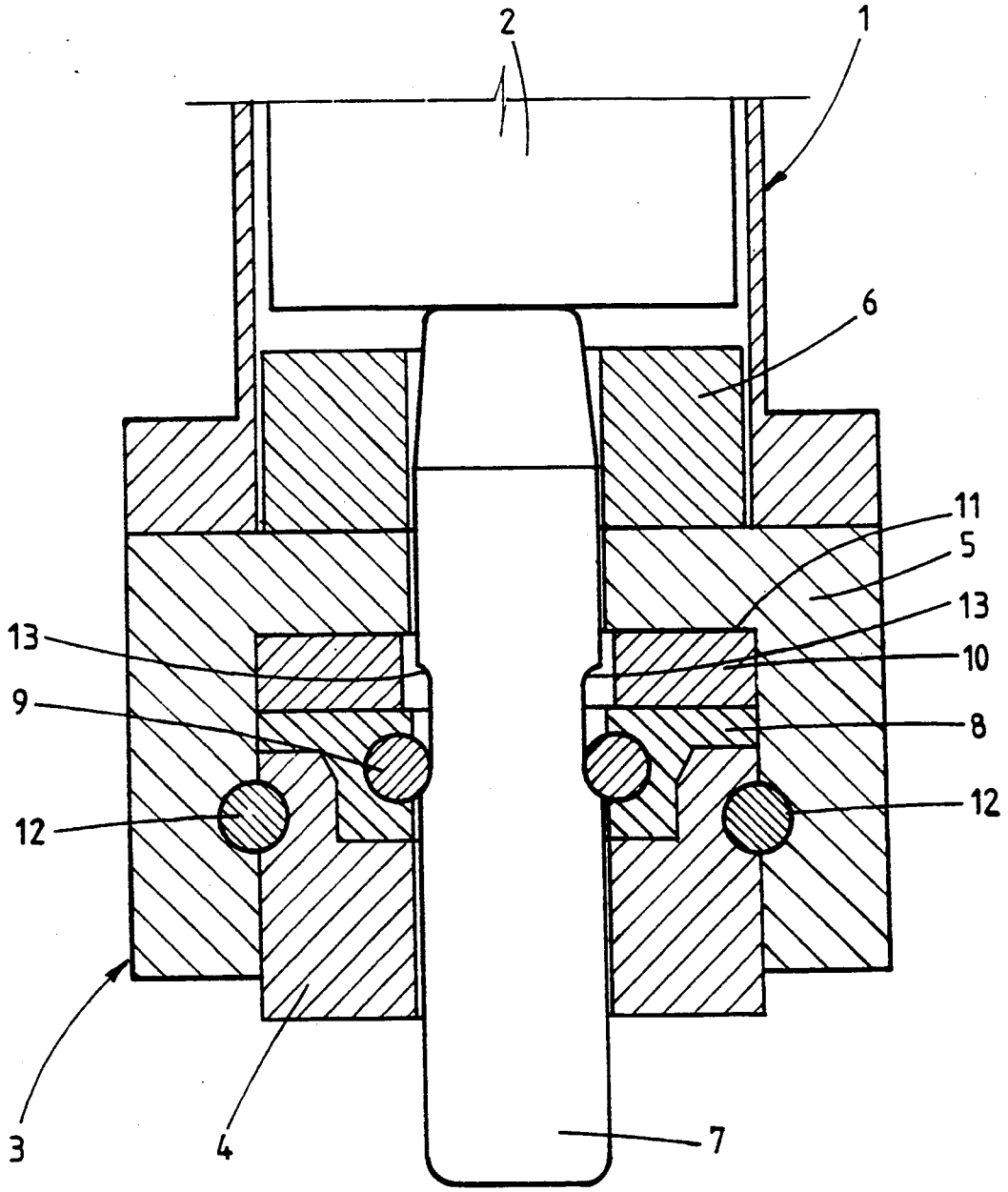
Figure 3:
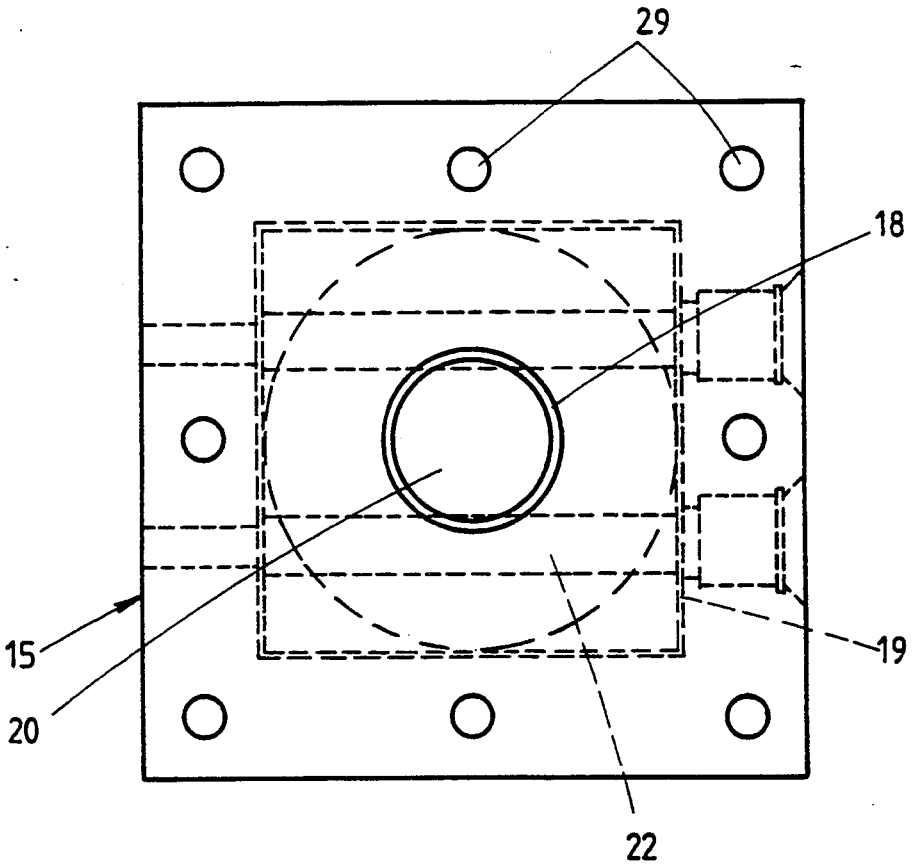
Figure 2:
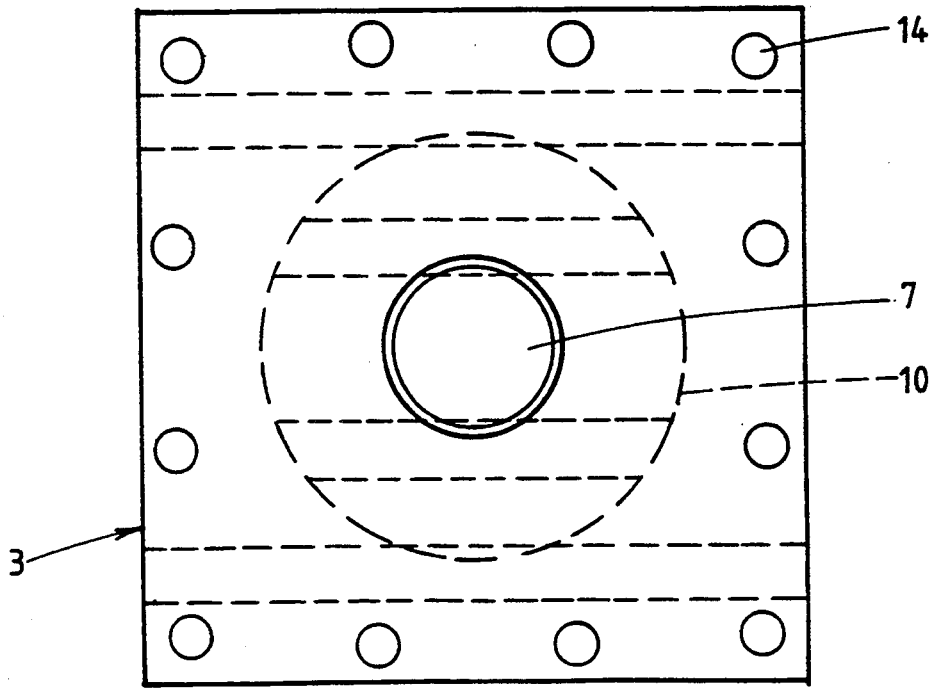
Figure 4:
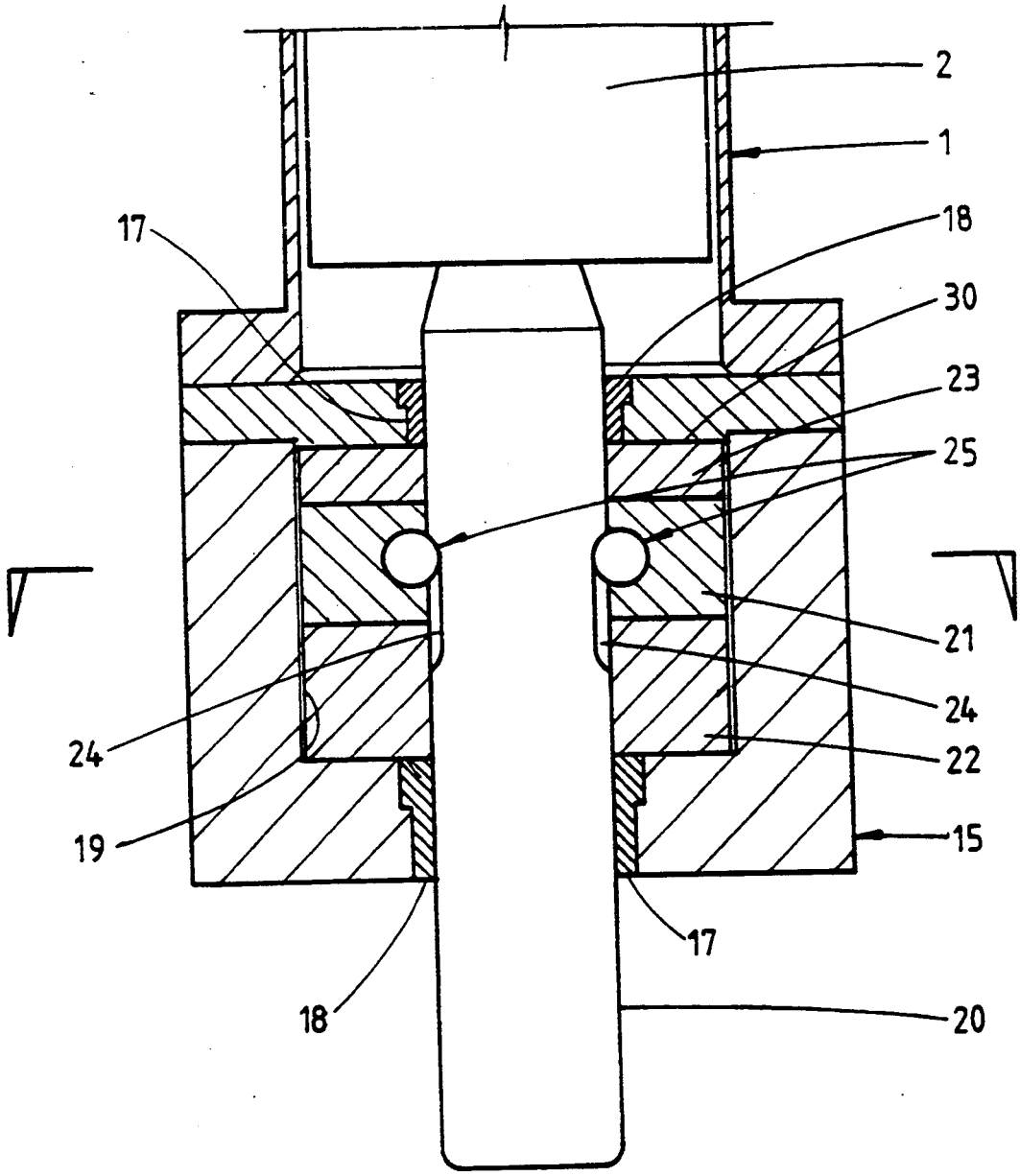
Figure 5:
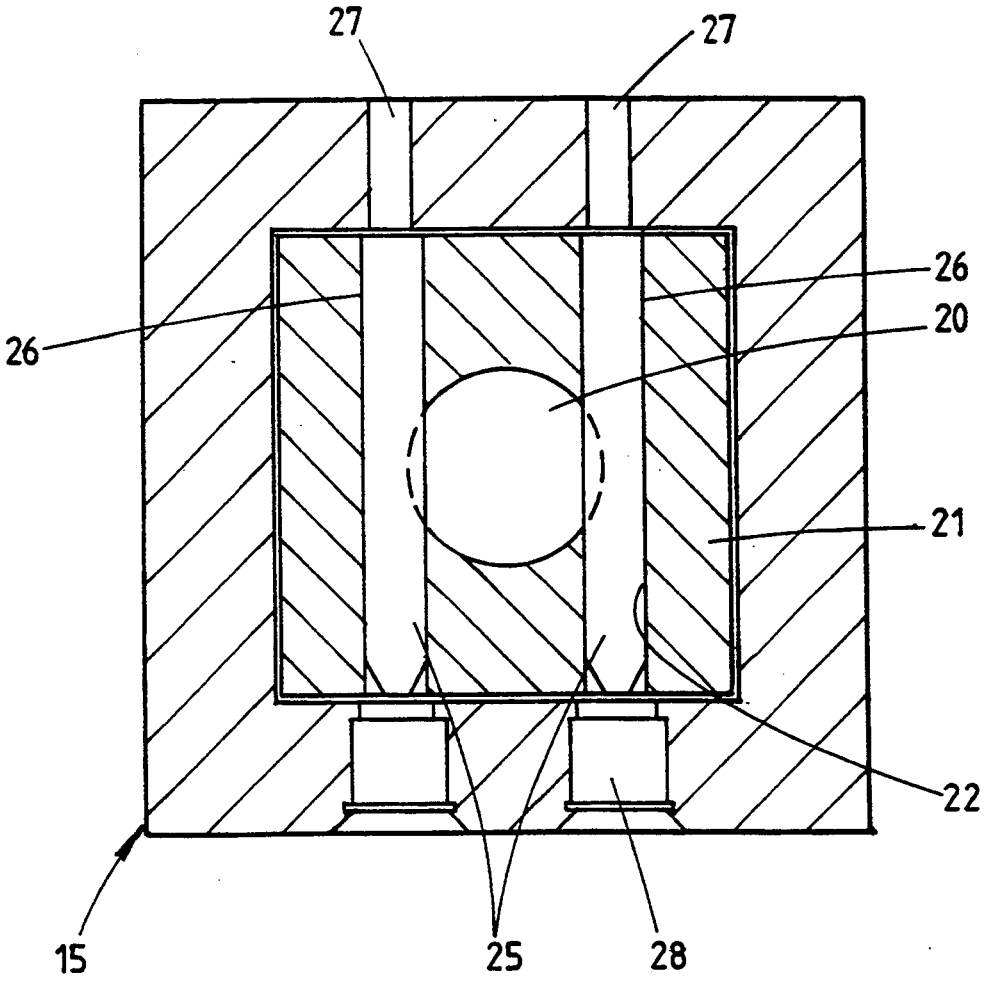
Figure 6:
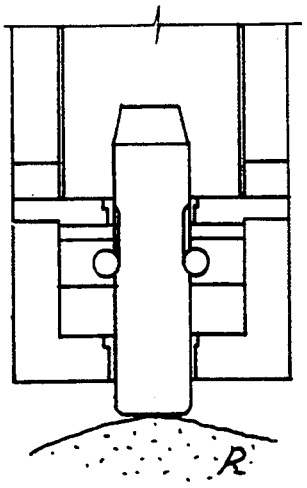
Figure 6A:
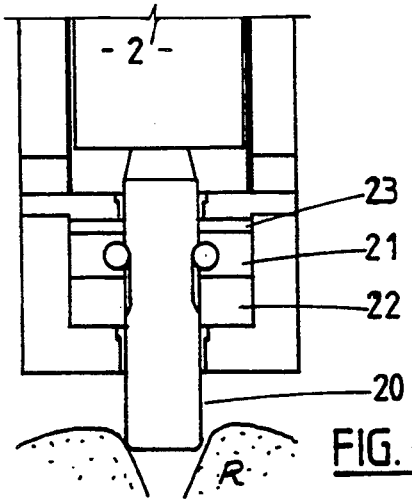
Figure 7:
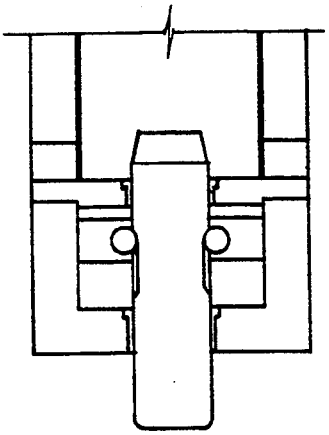
Figure 7A:
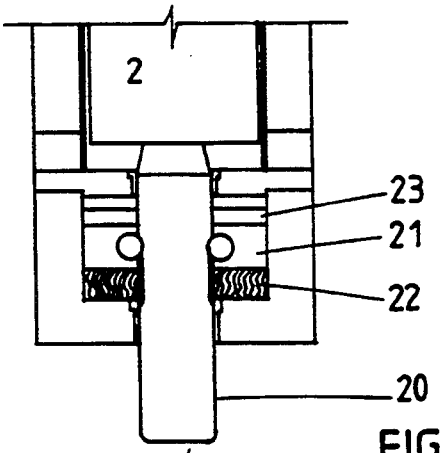
Figure 8:
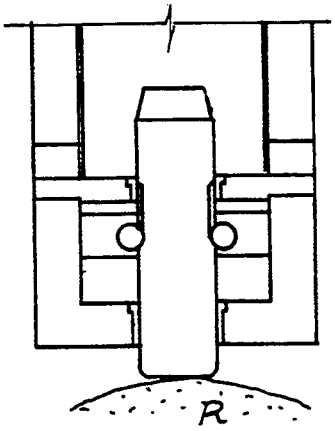
Figure 8A:
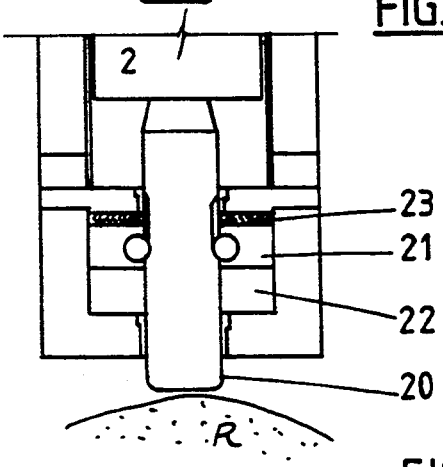

Aspects of the present invention will now be described by way of example only with reference to the accompanying drawings in which:

FIG. 1 is a cross-sectional drawing of a nose assembly for a rock breaking apparatus in accordance with one possible embodiment of the present invention, and FIG. 2 is an end view of a nose assembly for a rock breaking apparatus of FIG. 1, and FIG. 3 is an end view of a nose assembly for a rock breaking apparatus in accordance with a further embodiment of the present invention, and FIG. 4 is a sectional view through the nose assembly of FIG. 3, and FIG. 5 is a further sectional view through the assembly block of FIGS. 3 and 4, and FIGS. 6, 6*a*, 7, 7*a*, 8 and 8*a*are diagrammatic drawings illustrating striker pin positions for the apparatus of FIGS. 3, 4 and 5 during distinct operational situations.

With respect to FIGS. 1 and 2, the device comprises a hammer column generally indicated by arrow 1, a hammer 2 and an attached nose assembly generally indicated by arrow 3. The nose assembly 3 includes a closure bush 4, a recessed housing 5, and a primary shock absorbing means 6 which surrounds the inner end of a striker pin 7. The striker pin 7 is supported by a retainer 8 within the recessed portion of the recessed housing 5 and the permissible travel of the striker pin 7 is constrained through pins 9. A second or recoil shock absorbing means 10 is located between the retainer 8 and the inner wall 11 of the recess in housing 5. Retaining pins 12 secure the closure bush 4 with respect to the nose block housing 5. In operation striker pin 7 carries shock directly up from a rock (not shown) in the event that the rock does not break, and from striker pin 7 shock is transferred vertically to retainer 8. Shock is then transferred to recoil shock absorbing means 10.

Striker pin 7 has two recesses 13 on opposed sides thereof, producing a 'wasited' appearance. The surfaces of the recesses 13 are preferably milled flat, so that they may co-opearate with the pins 9 of striker pin retainer 8 which has a generally square shape. The recess 5 in the housing can be generally square as may be the retainer 8. To facilitate expansion the recoil shock absorbing means 10 can have a circular outer periphery.

The nose assembly 3 is secured to the hammer column 1 by a plurality of tie rods (not shown) which located in apertures 14 in the hammer column I and nose assembly 3.

In the assembly illustrated by FIGS. 3 to 5 is similarly fixed to a hammer column 1 and comprises a box-shaped nose assembly housing generally indicated by arrow 15 having upper and lower pin passages 16 and 17 respectively (which can incorporate plain bearings 18), a striker pin chamber 19 accommodating a striker pin 20, retainer 21, primary shock absorbing means 22 and recoil shock absorbing means 23. The primary shock absorbing means 22 is approximately two to five times the depth of the recoil shock absorbing means 23.

Striker pin 20 has two recesses 24 on opposed sides thereof, producing a 'waisted' appearance. The surfaces of the recesses 24 are preferably milled flat, so that they may co-operate with dowels 25 of retainer 21, which has a generally square shape. Apertures 26 are provided for co-operation with dowels 25 for securement of the striker pin 20 in the retainer 16.

It can be seen that the arrangement of FIGS. 3 to 5 provides a balanced manner of holding pin 15 in retainer 21, whilst allowing limited up and down movement.

Two sets of aligned apertures in the nose assembly are provided to facilitate removal and insertion of the dowels 25. A first set 27 of lesser diameter of the dowels 25 provide access to drive out the dowels 25, and a second set 28 larger than the dowels 25 enables the dowels to be inserted in the retainer 21. Apertures 28 can be blocked off with plugs (not shown) and a sealant can be used to block off apertures 27.

The assembly of FIGS. 3 to 5 is formed by assembling together the elements thereof by fixing bolts through apertures 29. Apart from the shock absorbing means, the preferred material of which has already been referred to, and the nose block, the elements may be made of steel or any other suitable material.

The material of shock absorbing means 22, 23 is resilient and is preferably polyurethane or rubber material. The shock absorbing means 22 and 23 can be in one piece as shown or made up from a number of pieces (not shown) of similar or varying resilience.

In operation the assembly of FIGS. 3 to 5 functions as follows:

The striker pin 20 is struck by a hammer 2 which transfers the shock through the pin to a subject rock. However, in order to prevent the striker pin 20 from taking up its full extent of axial movement and directly knocking into the nose assembly the direct primary shock absorbing means 22 is located in between the striker pin retainer 21 and the base 30 of the assembly such that upon full uptake of the striker pin 20 axial motion the pin retainer comes to rest against the direct primary shock absorbing means 22 thereby absorbing the shock.

Whilst the apparatus of FIGS. 1 and 2 utilizes a direct buffer as an annular shock absorber which directly interacts with the hammer to limit its motion location of the primary shock absorbing means 22 within the nose block housing as in the FIG. 3 to 5 embodiment maximises hammer travel.

The relocation of the direct buffer offers the advantage of including a more compact and sealed nose block assembly which is resistant to the incursion of debris and foreign matter. The assembly and durability are greatly enhanced while the fewer number of parts ensures a simpler, cheaper product.

FIGS. 6 to 8*a* illustrate striker pin positions for the nose block of FIGS. 3 to 5 in different operational modes.

In FIGS. 6 to 8*a* the pins is shown in "normal hit", "miss hit" and "ineffective hit" positions.

During a "normal hit" (FIGS. 6 and 6*a*) after pin 20 has been struck by hammer 2, and rock R is broken, the pin 20 moves from withdrawn to extended positions.

In the event of a "miss hit" (FIGS. 7 and 7*a*) the impact of the hammer 2 is absorbed by primary shock absorbing means 22.

In the event of an "ineffective hit" (FIGS. 8 and 8*a*) the pin 20 will recoil which is absorbed by shock absorber means 23 via retainer 21. Thus both in the "miss hit" and "ineffective hit" scenarios the affect of large shock loads on the nose block housing are substantially minimised.

I claim:

1. A nose assembly for a rock breaking apparatus comprising a housing having inner and outer pin passages, a striker pin chamber accommodating a striker pin and retainer, shock absorbing means positioned within the housing on opposite sides of the retainer, said striker pin being restrained by said retainer between extended and withdrawn positions and being slidable with respect to said pin passages, an inner end of the striker pin extending into a hammer chamber to which the nose block assembly is fixed whilst the other end of the striker pin extends outside the striker pin chamber, in which when said striker pin is struck by a hammer within the hammer chamber and penetrates an object the pin advances from a withdrawn to extended position, and in the event of a miss-hit or ineffective hit, shock absorbing means on one side of the retainer absorbs shock loads.

2. A nose assembly as claimed in claim 1 wherein the housing fully encloses the retainer and shock absorbing means.

3. A nose assembly as claimed in claim 2, the arrangement including a striker pin having opposed recesses and striker pin retainer, the striker pin retainer being adapted to receive said recesses to retain said striker pin with limited movement relative thereto wherein at the limit of striker pin extension further movement thereof is taken up by said retainer and transmitted to said shock absorbing means.

4. A nose assembly for a rock breaking apparatus comprising a housing having inner and outer pin passages, a striker pin chamber accommodating a striker pin and retainer, a first shock absorbing means positioned outside the housing, a second shock absorbing means positioned within the housing, said striker pin being restrained by said retainer between extended and withdrawn positions and being slidable with respect to said pin passages, an inner end of the striker pin extending into a hammer chamber to which the hose assembly is fixed while the other end of the striker pin extends outside the striker pin chamber, in which when said striker pin is struck by a hammer within the hammer chamber and penetrates an object the pin advances from a withdrawn to extended position, and in the event of a miss-hit, said first shock absorbing means absorbs shock loads, and in the event of an ineffective hit, said second shock absorbing means absorbs shock loads.

5. A nose assembly as claimed in claim 4, wherein the housing fully encloses the retainer and said second shock absorbing means.

6. A nose assembly as claimed in claim 4, the arrangement including a striker pin having opposed recesses and striker pin retaining means, the striker pin retainer being adapted to receive said recesses to retain said striker pin with limited movement relative thereto wherein at the limit of striker pin extension further movement thereof is taken up said retainer and transmitted to said second shock absorbing means.

* * * * *